US005429579A

United States Patent [19]

Nishihara

[11] Patent Number: 5,429,579

[45] Date of Patent: Jul. 4, 1995

[54] VARIBLE SIZE FOLDING MACHINE

[75] Inventor: Kunisuke Nishihara, Yokohama, Japan

[73] Assignee: Toshiba Kikai Kabushiki Kaisha, Tokyo, Japan

[21] Appl. No.: 214,743

[22] Filed: Mar. 18, 1994

[30] Foreign Application Priority Data

Mar. 19, 1993 [JP] Japan ..... 5-060202

[51] Int. Cl.[6] ..... B41F 13/60; B65H 45/28

[52] U.S. Cl. ..... 493/359; 493/324; 493/360

[58] Field of Search ..... 493/324, 356, 357, 358, 493/359, 360, 426, 427, 428, 429

[56] References Cited

U.S. PATENT DOCUMENTS

| | | | |
|---|---|---|---|
| 1,993,652 | 3/1935 | Dean | 493/360 |
| 2,017,619 | 10/1935 | Fritz | 473/357 |
| 2,070,324 | 2/1937 | Tornberg | 493/360 |
| 2,335,431 | 11/1943 | Meyer | 493/357 |
| 3,752,469 | 8/1973 | Kisjner | 493/357 |
| 3,843,113 | 10/1974 | Schaffer | 493/357 |
| 3,980,291 | 9/1976 | Loase | 493/430 |
| 4,822,329 | 4/1989 | Schneider | 493/353 |
| 4,861,326 | 8/1989 | Kuhner et al. | 493/359 |
| 4,969,862 | 11/1990 | Ehlscheid | 493/359 |

*Primary Examiner*—William E. Terrell

*Attorney, Agent, or Firm*—Cushman Darby & Cushman

[57] ABSTRACT

The present invention pertains to a variable size folding machine 10 in which a plurality of cross perforaters 61, 62, and 63 are disposed. Any of the plurality of cross perforaters 61, 62, and 63 may be selected for forming lateral perforations on a signature 15 of a corresponding size. A lateral perforated line is applied by the selected cross perforater to the print paper 14A–14F printed in the printing machine and delivered therefrom. Each of the cross perforaters 61, 62, and 63 can be integrated and moved as a cross perforater unit 60 to thereby select a particular cross perforater.

9 Claims, 9 Drawing Sheets

VARIBLE SIZE FOLDING MACHINE

BACKGROUND OF THE INVENTION

1. Field of the Invention

The present invention concerns a variable size folding machine for a printing machine having a plurality of plate cylinder sizes such as a rotary gravure press and it relates to a cross perforater for forming a lateral perforated line to a print paper after printing.

2. Description of the Related Art

Generally, a print paper continuously printed in a printing machine is fed from an upper folder to the inside of a folding machine, in which the printed paper is properly applied with longitudinal or lateral cutting and folding and then discharged as signatures from the folding machine. In this case, a plurality of plate cylinders having different sizes (plate cylinder diameter) are sometimes used in a printing machine for applying printing on the print paper and, correspondingly, a variable size folding machine capable of folding different sizes of signatures is used also as the folding machine disposed at the downstream of the printing machine.

FIG. 8 shows a portion of a variable size folding machine 900 as an example of such a variable size folding machine in the prior art.

In FIG. 8, the variable size folding machine 900 is adapted to introduce a print paper 901 printed continuously by a printing machine such as a rotary printing press at the upstream, from an upper folder not illustrated, which is then cut and put to lateral folding and chopper folding (longitudinal folding) and discharged as folded sections 902. The variable size folding machine 900 comprises nipping rollers 903, 904 and 905, 906, a male cutting cylinder 910 and a female cutting cylinder 911, a signature acceleration conveyor 920, an gripper & tucking cylinder 930, a jaw cylinder 940, an upper slow-down cylinder 950 and a lower slow-down cylinder 951 and choppers 960, 961, which are arranged from the upstream in the delivering direction of the print paper 901 or the signature 902, that is, from the side of the upper folder.

In such a variable size folding machine 900, the print paper 901 delivered continuously from the printing machine is introduced from the upper folder not illustrated, delivered to the male cutting cylinder 910 and the female cutting cylinder 911 while being held by the nipping rollers 903, 904 and 905, 906, in which it is cut into signatures 902 of a predetermined size. The cut signatures 902 are accelerated, being put between belts 921 and 922 from both sides in the signature acceleration conveyor 920 and then handed to the gripper & tucking cylinder 930.

The gripper & tucking cylinder 930 has chuck fingers 932, and the cut and accelerated signature 902 is gripped at the top end by the chuck finger 932 and sent to the jaw cylinder 940. Further, the gripper & tucking cylinder 930 has insertion plates 931 situated alternately with the chuck fingers 932. The insertion plate 931 is inserted into the direction of the jaw cylinder 940 at a portion of contact between the jaw cylinder 940 and the gripper & tucking cylinder 930, by which the folded section 902 is caught at its lateral folding position (about at a mid portion) by a chuck plate 941 and a chuck jaw 942 of the jaw cylinder 940 and then sent to the upper and the lower slow-down cylinders 950 and 951.

Belts 952 and 953 are wound around (as shown by dotted chains in FIG. 8) the upper and the lower slow-down cylinders 950 and 951, and belts 954 and 955 are wound around (as shows by dotted lines in FIG. 8) below each of the slow-down cylinders 950 and 951 so as to oppose the above-mentioned belts 952 and 953 respectively.

Each of the slow-down cylinders 950 and 951 has a chuck finger 957 that catches the signature 902 sent from the jaw cylinder 940 at a laterally folded position and the signatures 902 are alternately distributed into upper and lower portions by the chuck fingers 57 of the upper and the lower slow-down cylinders 950 and 951.

Then, the signatures 902 distributed into the upper and lower portions are delivered, in the laterally folded state, while being put between the belts 952 and 954 and the belts 953 and 955 to each of choppers 960 and 961 at the downstream, in which they are put to chopper folding and discharged by way of a conveyor or the like.

In such a variable size folding machine 900, since the delivery speed of the print paper 901 after cutting, that is, the delivery speed of the signatures 902 after delivered from the signature acceleration conveyor 920 is set to higher than a surface circumferential speed of the plate cylinder of the maximum size among a plurality of plate cylinder sizes in the printing machine at the upstream, that is, since it is set to greater than the maximum delivery speed of the print paper 901 in a continuous state before cutting, it can cope with all sorts of plate cylinder sizes, that is, all of the sizes of the signatures 902.

However, in such an existent variable size folding machine 902, since the print paper 901 is cut in the male cutting cylinder 910 and the female cutting cylinder 911, then accelerated by the signature acceleration conveyor 920 and laterally folded being gripped by each of the cylinders on and after the gripper & tucking cylinder 930, there has been a problem that an accuracy for lateral folding is not satisfactory as compared with a case of cutting the print paper after gripping by the chuck fingers in the existent fixed type folding machine.

That is, in a process where the print paper 901 is accelerated after cutting and then gripped, there has been a problem that the signature 902, can not be gripped stably at predetermined positions upon gripping by the chuck finger 932 of the gripper & tucking cylinder 930, gripping by the chuck plate 941 and the chuck jaw 942 of the jaw cylinder 940 or gripping by the chuck finger 957 of each of the slow-down cylinders 950 and 951.

Further, such a variable size folding machine 900 has involved a problem of requiring much time and labour for adjusting the phase between each of the cylinders so that the lateral folding is applied at a predetermined position of the signature 302, in a case if the type of the print paper 901 is changed.

Further, in a case of printing books or publication matters, chopper folding (longitudinal folding) is further applied after the lateral folding as done in each of the choppers 960 and 961 in the variable size folding machine 900. However, this has caused a problem that fold wrinkles 970 which are referred to "gutter wrinkles" are liable to occur at a portion inside the chopper fold (portion A in the figure) as shown in FIG. 7, particularly, in a case where the signature 902 is folded into 16 or more pages.

In view of the problem for the accuracy in lateral folding or a problem of "gutter wrinkles" in such a variable size folding machine 900, a counter measure may be considered to form a lateral perforated line at a position of a lateral score before lateral folding.

That is, when a lateral perforated line 971 is formed previously as shown in FIG. 10, stable lateral folding (portion B in the figure) can be applied at a predetermined position of the signature 902, and occurrence of "gutter wrinkles can be eliminated because air in the signature 902 escapes through apertures of the lateral perforated line 971 upon chopper folding.

However, as an actual problem, the existent variable size folding machine 900 can not be provided with a cross perforater for forming the above-mentioned lateral perforated line by the reasons described below.

That is, the print paper (web) 901 printed by a plate cylinder of the printing machine at the upstream and sent in the continuous state therefrom is delivered at a speed equal with the surface circumferential speed of the plate cylinder of the printing machine. However, since the printing machine at the upstream of the variable size folding machine 900 has a plurality of plate cylinder sizes (plate cylinder diameter), the surface circumferential speed of the plate cylinder varies in accordance therewith and, thus, the delivering speed of the print paper 901 varies.

In this case, for fabricating the lateral perforated line 971 to the print paper 901 in the form of the web, the surface circumferential speed of the lateral line perforation cylinder and the leteral line female perforation cylinder of the cross perforater for forming the lateral perforated line 971 has to be aligned with the surface circumferential speed of the plate cylinder of the printing machine, that is, the delivering speed of the print paper 901 in the form of the web. If the delivering speed of the print paper 901 does not match the surface circumferential speed of the lateral line perforation cylinder and the leteral line female perforation cylinder, the lateral perforated line 971 is drifted in the delivering direction of the print paper 901, as well as the printing quality is deteriorated due to friction between the surface of the print paper 901 and the surface of the lateral line perforation cylinder and the leteral line female perforation cylinder. Accordingly, if the delivering speed of the print paper 901 varies due to the presence of a plurality of plate cylinder sizes, the surface circumferential speed of the lateral line perforation cylinder and the leteral line female perforation cylinder of the cross perforater have also to be varied in accordance therewith.

By the way, in order to change the surface circumferential speed by using identical lateral line perforation cylinder and leteral line female perforation cylinder, namely, without changing the diameter of such cylinders, it may be considered to change the rotational speed (number of rotation) of such cylinders, for example, by using a speed changing device.

However, since the rotational speed (number of rotation) of the lateral line perforation cylinder and the leteral line female perforation cylinder of the cross perforater and the rotational speed (number of rotation) of the plate cylinder of the printing machine is set to a constant rotational ratio, the rotational speed of the lateral line perforation cylinder and the leteral line female perforation cylinder can not be changed by using the speed changing device or the like and, accordingly, the surface circumferential speed of the lateral line perforation cylinder and the leteral line female perforation cylinder can not be changed.

The rotational speed of the lateral line perforation cylinder and the leteral line female perforation cylinder and the rotational speed of the plate cylinder of the printing machine have to be kept at a constant rotational ratio, because the lateral perforated line 971 has always to be fabricated at a predetermined position to a signature 902 and, accordingly, the number of sheets printed per unit time by the plate cylinder of the printing machine (corresponding to the signature 902) and the number of sheets per unit time applied with the lateral perforated line 971 by the lateral line perforation cylinder and the leteral line female perforation cylinder (corresponding to the folded section 902) have to be aligned.

If the rotational speed of the lateral line perforation cylinder and the leteral line female perforation cylinder were changed by using a speed changing device or the like, since the constant rotational ratio described above can not be maintained, the lateral perforated line 971 can not be applied always at the predetermined position of the signature 902. This results in such a disadvantage that the position for the lateral perforated line 971 gradually displaces relative to the signature 902 or lateral perforated lines 971 are formed at a plurality of portions to one signature 902, or a signature 902 not having the lateral perforated line 971 will result.

With the reasons as described above, the variable size folding machine 900 could not be provided with the cross perforater so far.

An object of the present invention is to provide a variable size folding machine capable of improving an accuracy of the lateral folding of a signature and capable in preventing occurrence of folding wrinkles.

SUMMARY OF THE INVENTION

The present invention intends to attain the foregoing object by providing a variable size folding machine with a plurality of cross perforaters corresponding to different sizes of signatures.

Specifically, the variable sizes folding machine according to the present invention comprises a plurality of cross perforaters for forming lateral perforated lines to a print paper, in which a plurality of the cross perforaters are corresponded to different sizes of the signatures of the print paper respectively and one of a plurality of the cross perforaters can optionally be put selectively on a delivering line of the print paper.

In a preferred embodiment of the variable size folding machine according to the present invention, a plurality of the cross perforaters is arranged and secured to a cross perforater unit, and the cross perforater unit is made movable such that optional one of the cross perforaters can situate at a predetermined position on the delivering line of the print paper.

In another preferred embodiment, the variable size folding machine according to the present invention comprises clutch mechanisms for individually connecting and disconnecting rotational transmission between a plurality of the cross perforaters and a main body driving portion respectively, in which a portion on the side of the cross perforater and another portion on the side of the main body driving portion in each of the clutch mechanisms can be connected only at a predetermined angle relative to each other.

In the present invention as described above, a plurality of cross perforaters are disposed to the variable size folding machine, a corresponding cross perforaters is selected from a plurality of the cross perforaters in accordance with the plate cylinder size of the printing machine at the upstream, in other words, in accordance with the size of the signature and fabricating a lateral perforated line by the selected cross perforaters to a print paper printed by the printing machine and delivered therefrom.

Therefore, an appropriate lateral perforated line can be fabricated to an optional signature size of the printed paper in the variable size folding machine, thereby improving the accuracy in lateral folding and preventing occurrence of folding wrinkles.

In the preferred embodiment, since a plurality of the cross perforaters are integrated into a cross perforater unit and the cross perforater unit is made movable by a moving means such as threaded shafts, operation for selecting the cross perforater can be facilitated.

In another preferred embodiment, since the clutch mechanism is disposed to each of a plurality of the cross perforaters, cross perforaters not used among a plurality of the cross perforaters can be separated from the main body driving portion and stopped by the clutch mechanism to avoid wasteful energy consumption. Further, since the clutch mechanism is connected only at a predetermined relative angle, this can prevent phase shift upon connection between each of the cross perforaters and the main body driving portion.

The fabrication of an appropriate lateral perforated line to a signature of an optional size described above can be applied more easily and reliably to attain the foregoing object.

DETAILED DESCRIPTION OF THE PREFERRED EMBODIMENT(S)

Description will be made to a preferred embodiment according to the present invention with reference to the drawings.

Figure 1:
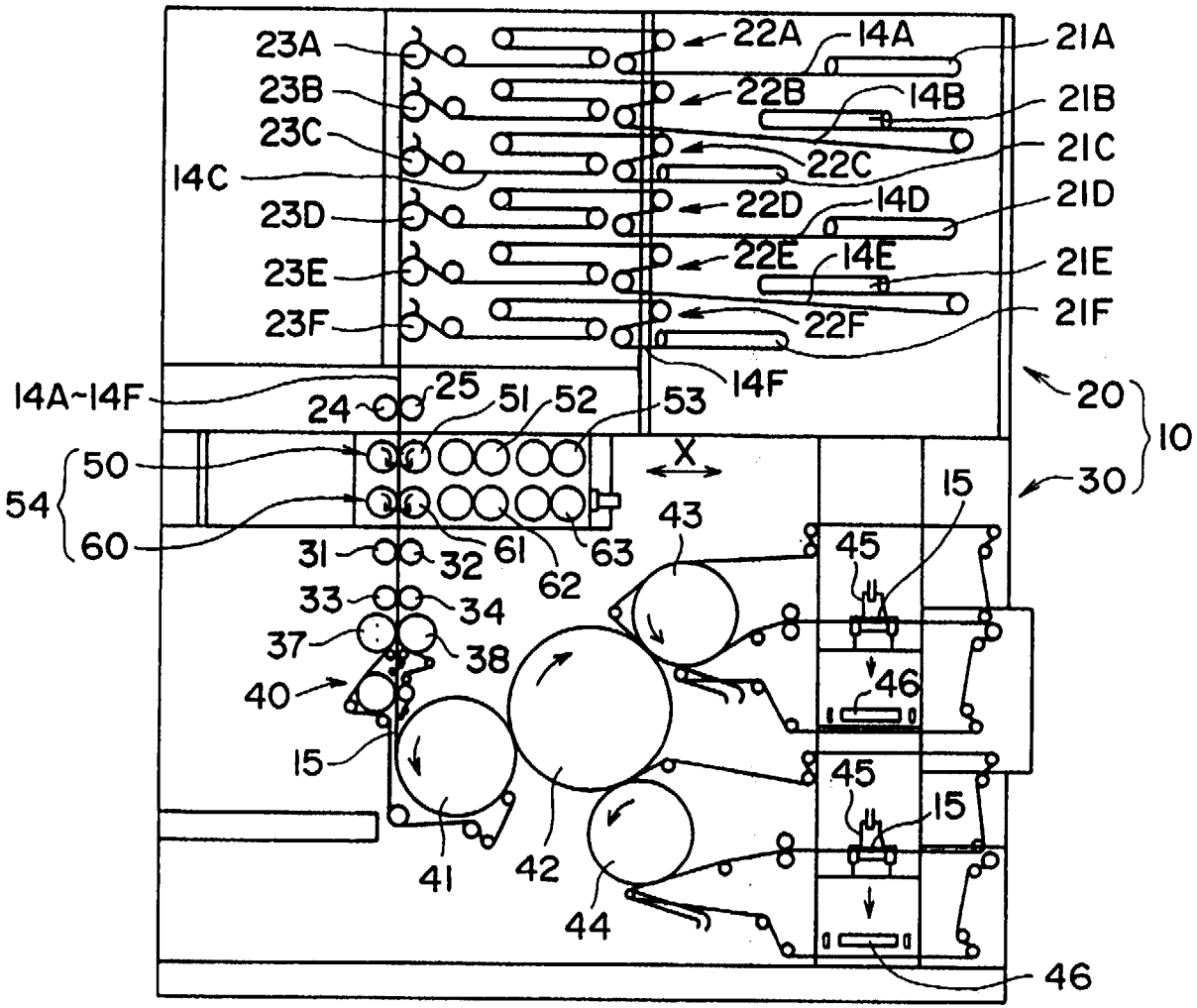
FIG. 1 is a view illustrating an entire view for the constitution of an embodiment according to the present invention.

FIG. 1 shows an entire constitution of a variable size folding machine 10 according to the present invention.

The variable size holding machine 10 comprises an upper folder 20 for introducing a web 11 (not illustrated) which is a continuous print paper printed by a printing machine at the upstream, and a lower folder 30 disposed to the downstream thereof for conducting cutting, lateral folding, chopper folding or the like to the web 11.

The upper folder 20 is adapted to slit the printed web 11 by five slitters (not illustrated) into six ribbons 14A, 14B, 14C, 14D, 14E and 14F, change the running direction of the ribbons 14A–14F by six turn bars 21A, 21B, 21C, 2D, 21E and 21F, respectively, adjusting the delivering phase of each of the ribbons 14A–14F by six sets of compensater rollers 22A, 22B, 22C, 22D, 22E and 22F, respectively, and send them downward by each of the ribbon drug rollers 23A, 23B, 23C, 23D, 23E and 23F and stack them. At the downmost stream of the upper folder 20, nipping rollers 24 and 25 are disposed for delivering the ribbons 14A–14F, while holding each of them, to the lower folder 30 at the downstream.

The lower folder 30 has, at the uppermost stream, three timed timed longitudinal line male perforaters 51, 52 and 53 for forming a longitudinal perforated line to each of the ribbons 14A–14F and three cross perforaters 61, 62 and 63 for forming a lateral perforated lines to each of the ribbons 14A–14F. The timed timed longitudinal line male perforaters 51, 52 and 53 constitute a timed timed longitudinal line male perforater unit 50 and the cross perforaters 61, 62 and 63 constitute a cross perforater unit 60. Further, the timed timed longitudinal line male perforater unit 50 and the cross perforater unit 60 are integrated to constitute a line perforater unit 54, the details of which will be described later. The constitution at the downstream of the line perforater unit 54 is identical with that of the variable size folding machine 900 in the prior art described above and it comprises, from the upstream, nipping rollers 31, 32 and 33, 34, a male cutting cylinder 37 and a female cutting cylinder 38, a signature acceleration conveyer 40, an gripper & tucking cylinder 41, a jaw cylinder 42, an upper slow-down cylinder 43 and a lower slow-down cylinder 44, two upper and lower choppers 45, and two upper and lower conveyers 46. Since the function of each of the portions is identical with that in the variable size folding machine 900 in the prior art as described above, detailed descriptions therefor will be omitted.

Figure 2:
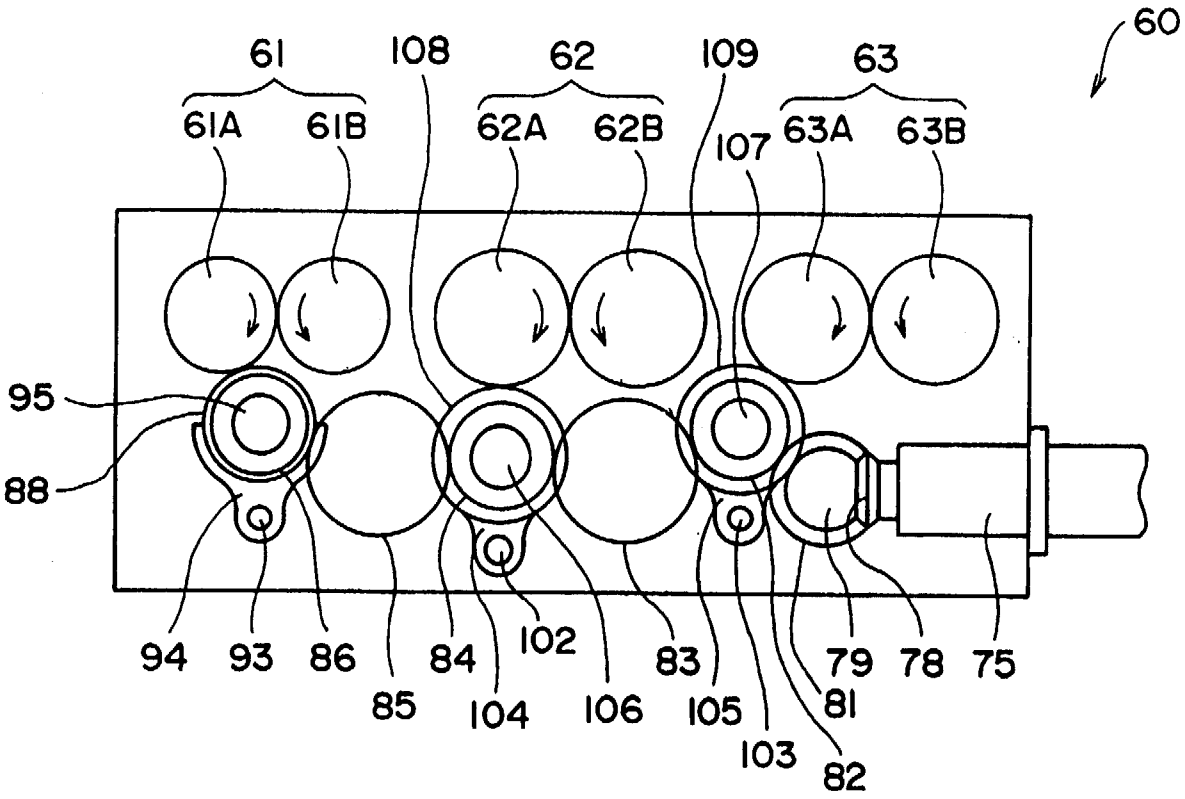
FIG. 2 is a vertical cross sectional view for a portion of the embodiment described above.
Figure 3:
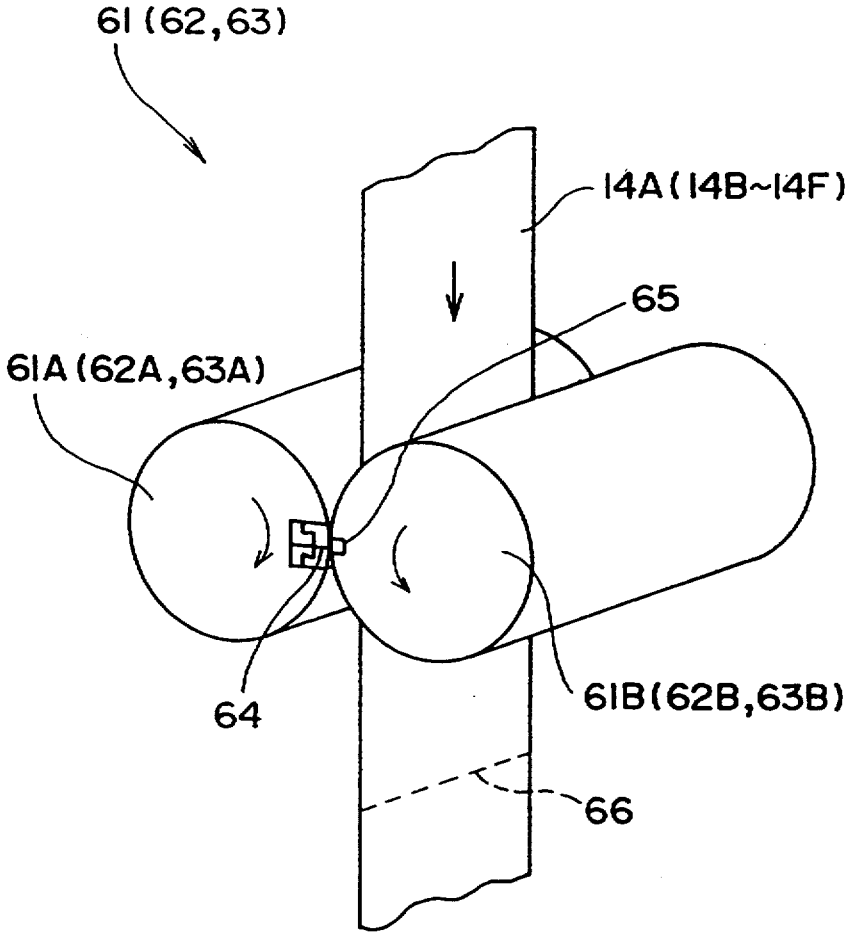
FIG. 3 is a view for explaining fabrication of a cross perforated line in the embodiment.
Figure 4:
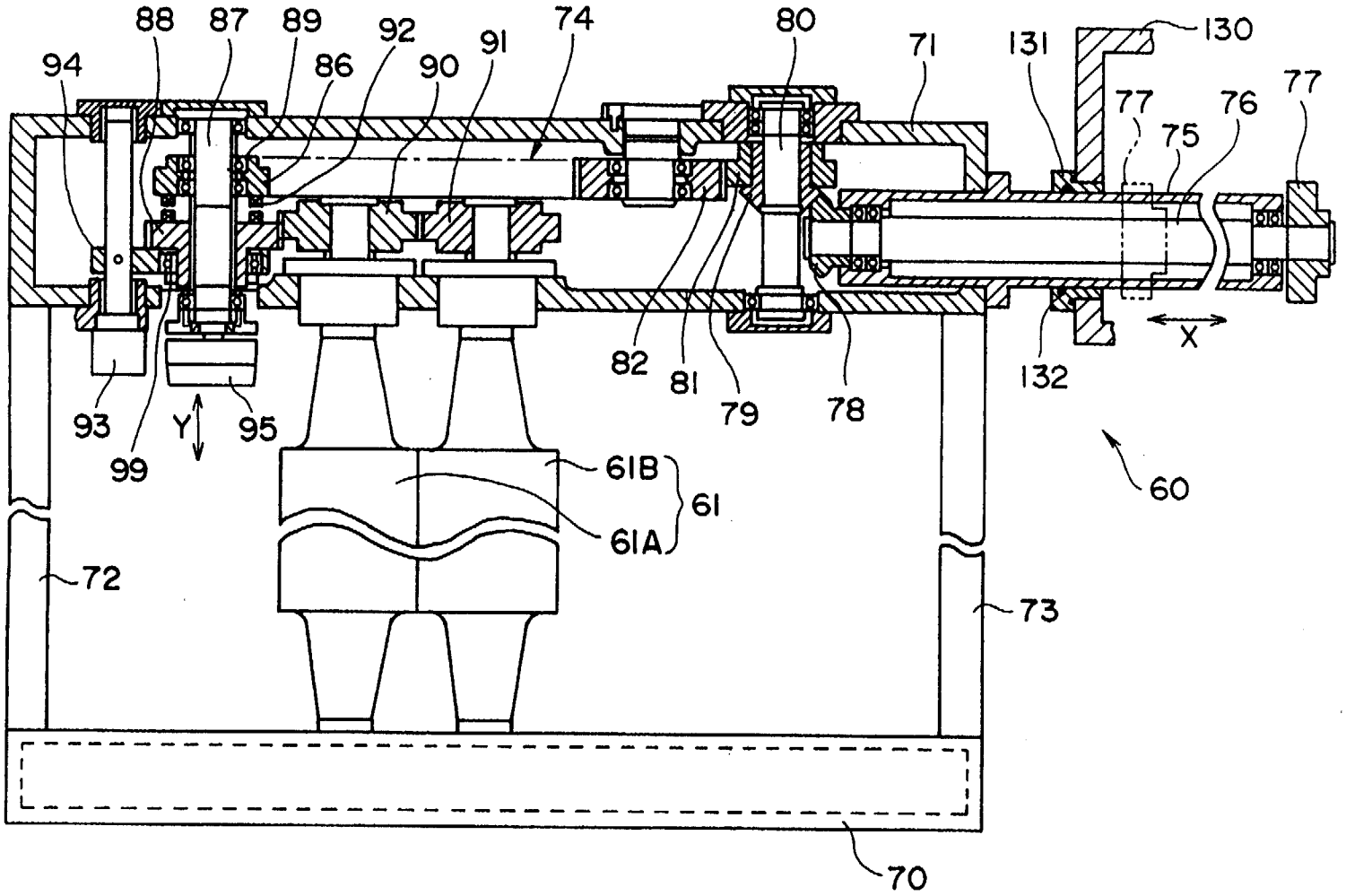
FIG. 4 is a horizontal cross sectional view for a portion of the embodiment.

FIG. 2 through FIG. 4 show details for a portion of the cross perforater unit 60 in the line perforater unit 54. FIG. 2 is a vertical cross sectional view of the cross perforater unit 60 including a driving mechanism, FIG. 3 is a detailed view for each of the cross perforaters in the cross perforater unit 60 and FIG. 4 is a horizontal cross sectional view of the cross perforater unit 60 including a driving mechanism.

In FIG. 2, the cross perforater unit 60 has the three cross perforaters 61, 62 and 63 as described above and each of the cross perforater units 61, 62 and 63 has each pair of the lateral line perforation cylinders and the leteral line female perforation cylinders 61A, 61B; 62A, 62B; and 63A, 63B, respectively.

As will be detailed later, one out of three pairs of the lateral line perforation cylinders and the leteral line female perforation cylinders 61A, 61B; 62A, 62B; and 63A, 63B is selected and used in accordance with the plate cylinder size of the printing machine at the upstream and the size (outer diameter of the cylinder) is different from each other.

For example in this embodiment, the size of the lateral line perforation cylinder 61A and the lateral line perforation receiver cylinder 61B corresponds to the plate cylinder size of $38\frac{3}{4}$ inch ($19\frac{3}{8}$ inch in the size of the signature), the size of the lateral line perforation cylinder 62A and the leteral line female perforation cylinder 62B corresponds to the plate cylinder size of $45\frac{1}{2}$ inch ($22\frac{3}{4}$ inch in the size of the signature), and the size of the lateral line perforation cylinder 63A and the leteral line female perforation cylinder 63B corresponds to the plate cylinder size of 42 inch (21 inch in the size of the signature). Each of the dimensional values showing the signature size is a dimensional value in the direction crossing the lateral perforated line of the signature 15 in a state once folded laterally at a position of the lateral perforated line.

In FIG. 3, each of the lateral line perforation 61A, 62A and 63A has a lateral line perforating blade 64 formed at the outer circumference thereof, and each of the leteral line female perforation cylinder 61B, 62B and 63B has a perforating blade receiving rubber 65 formed at the outer circumference thereof corresponding to the position of the lateral line perforating blade 64.

Each of the cross perforaters 61, 62 and 63 is adapted to fabricate a lateral perforated line 66 by the lateral perforating blade 64 to each of the ribbons 14A–14F delivered from each of the longitudinal perforaters 51, 52 and 53 while being held at upper and lower positions by each of the nipping rollers 24, 25 and 31, 32. The circumferential surface speed at the outer circumference of each of the lateral line perforation cylinder 61A, 62A and 63A and each of the leteral line female perforation cylinders 61B, 62B and 63B, namely, the speed of the lateral line perforating blade 64 is substantially equal with the delivering speed of the ribbons 14A–14F, so that the lateral perforated line 66 is not drifted toward the delivering direction.

In FIG. 4, the cross perforater unit 60 has an operation side frame 70 and a transmission side frame 71 on both axial ends for each of the cylinders of each of cross perforaters 61, 62 and 63, in which the operation side frame 70 and the transmission side frame 71 are secured to each other by means of stays 72 and 73.

Each of the cross perforaters 61, 62 and 63 is adapted to be movable by a moving means 128 to be described later in the direction X of FIG. 1 or FIG. 4, being integrated with the operation side frame 70 and the transmission side frame 71 as the cross perforater unit 60. In FIG. 4, the cross perforaters 62 and 63 are omitted in order to avoid complexity of the drawing.

A driving mechanism 74 for each of the cross perforaters 61, 62 and 63 is disposed within the transmission side frame 71. A tubular shaft bearing 75 is disposed to a right portion of the transmission side frame 71 in FIG. 4, and an input shaft 76 supported by the shaft bearing 75 is disposed in the shaft bearing 75.

An input gear 77 is disposed to one end of the input shaft 76 for inputting a driving force from a driving source to be described later, and a bevel gear 78 is disposed to the other end of the shaft 76 for transmitting the driving force to the driving mechanism 74.

The tubular shaft bearing 75 secured to the transmission side frame 71 is supported by a flange 131 disposed to a main body frame 130 which is a stationary portion of the lower folder 30 and is made slidable with the flange 131. With such a constitution, the input gear 77 is made movable in the main body frame 130 in the direction X of FIG. 4 (shown by the dotted chain in the drawing).

The flange 131 incorporates an O-ring 132, and the O-ring 132 prevents lubricants in the main body frame 130 from leaching to the outside (a portion in which the printed paper runs).

In FIGS. 2 and 4, rotational driving for the bevel gear 78 is transmitted to a bevel gear 79, which causes a shaft 80 and a gear 81 secured to the shaft 80 to rotate, so that each of idler gears 82, 83, 84, 85 and 86 is rotationally driven successively. In FIG. 4, the idler gears 83, 84 and 85 are shown simply by a dotted chain. The idler gear 86 is supported by way of a bearing 89 to a shaft 87. A gear 88 is attached to the shaft 87 slidably in the direction Y of FIG. 4, in which the rotation of the gear 88 is transmitted to a gear 90 disposed to the shaft end of the lateral line perforation cylinder 61A and further to a gear 91 disposed to the shaft end of the leteral line female perforation cylinder 61B, by which the lateral line perforation cylinder 61A and the leteral line female perforation cylinder 61B that constitute theateral line perforater 61 are adapted to be rotated in synchronization in the directions opposite to each other.

A clutch 92 is disposed between the idler gear 86 and the gear 88. Further, an air cylinder 93 is disposed near the shaft 87 with the axial line being in parallel with the shaft 87. The gear 88 is connected by way of a bearing 99 to the air cylinder 93 through an arm 94 secured to the air cylinder 93.

The air cylinder 93 is actuated upon selection as to whether the cross perforater 61 is used or not and adapted to move the arm 94 in the direction Y of FIG. 4, thereby moving the gear 88 by way of the bearing 99 in the direction Y of FIG. 4, to connect and disconnect the clutch 92.

When the clutch 92 is in a connected state, rotation of the idler gear 86 is transmitted from the clutch 92 to the gear 88, by which the lateral line perforation cylinder 61A and the leteral line female perforation cylinder 61B of the cross perforater 61 are driven. On the other hand, when the clutch 92 is in a disconnected state, the idler gear 86 is rotated but the rotation is not transmitted to the gear 88, so that operation of the lateral line perforation cylinder 61A and the leteral line female perforation cylinder 61B of the cross perforater 61 are stopped.

The number of rotation of the shaft 87 used as a shaft of the clutch 92 is equal with the number of rotation of the lateral line perforation cylinder 61A and the leteral line female perforation cylinder 61B, and the clutch 92 is made connectable only at a predetermined angle in one rotation of each of the cylinders 61A and 61B. Namely, a connection mechanism comprising, for example, a combination of protrusion and recess is disposed on the side of the idler gear 86 and on the side of the gear 88 of the clutch 92, which engage to each other only at a predetermined angle in one rotation for 360°, to constitute the clutch 92 as a so-called one tooth clutch. Therefore, the phase between the cross perforater 61 and other portion of the lower folder 30 such as the gripper & tucking cylinder 41 does not shift upon connection and disconnection of the clutch 92.

An air brake 95 is disposed to the end of the shaft 87. The air brake 95 is disposed so that the lateral line perforation cylinder 61A and the leteral line female peroration cylinder 61B can be prevented from rotation by the transmission of the rotation of the idler gear 86 by way of the bearing 89 to the shaft 87 or each of the cylinders 61A, 61B can be prevented from rotation by vibration or the like in a state when the cross perforater 61 is not used, that is, when the clutch 92 is in a disconnected state.

Further, as shown in FIG. 2, the cross perforaters 62 and 63 are also adapted to be driven in the same manner as the cross perforater 61. That is, each of the cross perforaters 62 and 63 is adapted to operate by receiving driving transmission from each of the idler gears 84 and 82 corresponding to the idler gear 86 to each of the gears 108 and 09 corresponding to the gear 88.

Like that the cross perforater 61, each of the cross perforaters 62 and 63 has a clutch 100, 101 (not illustrated), an air cylinder 102, 103, an arm 104, 105 and an air brake 106, 107 individually. With such a constitution, one of the three cross perforaters 61, 62 and 63 is selected optionally in accordance with the plate cylinder size of the printing machine, while the remaining two liner perforaters are put to a not-used state in which the clutch is disconnected.

Figure 5:
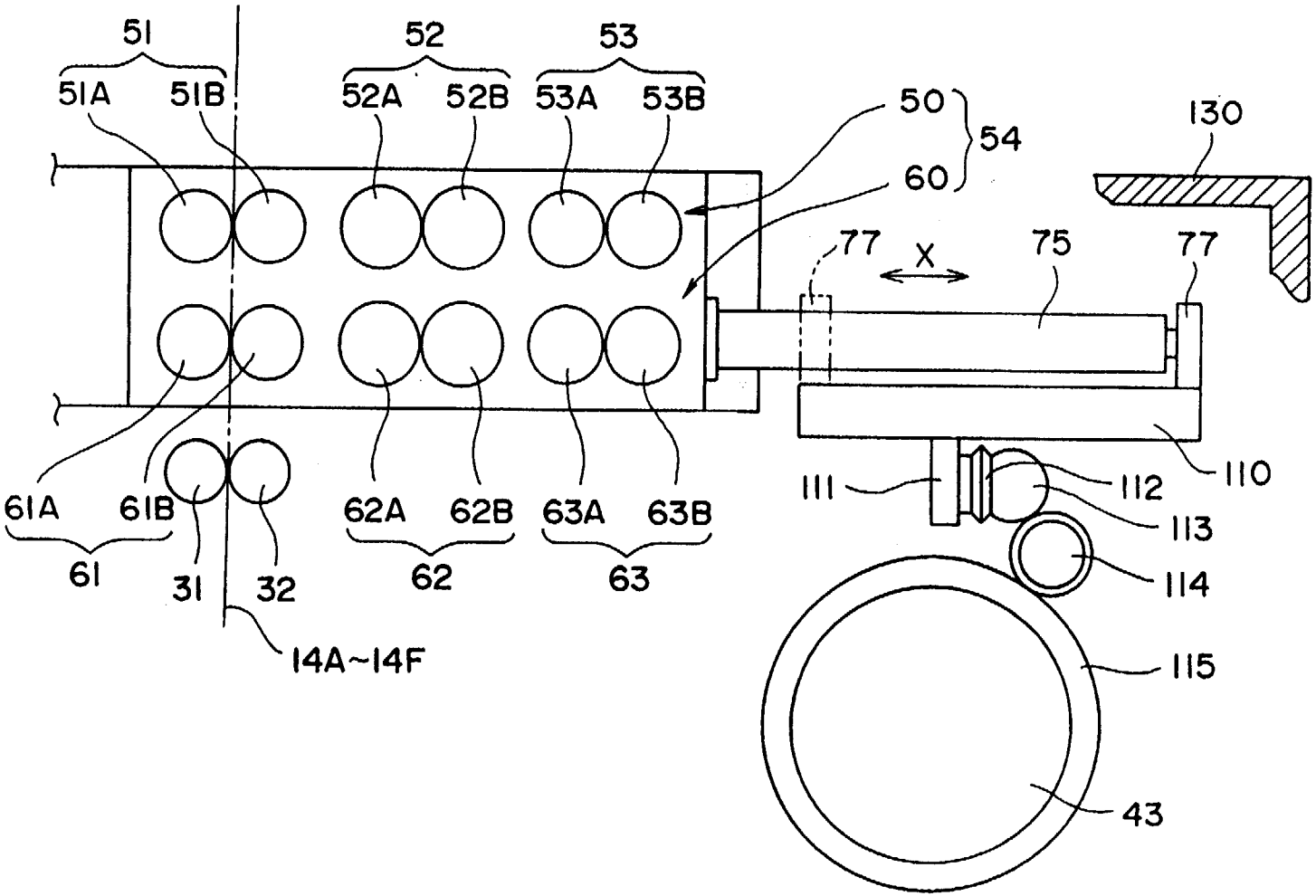
FIG. 5 is a view for explaining a portion of the embodiment and a driving source therefor.

In FIG. 5, the timed longitudinal line male perforater unit 50 is disposed to the upstream of the cross perforater unit 60 as described above, and each of the timed longitudinal line male perforaters 51, 52 and 53 of the timed longitudinal line male perforater unit 50 has each pair of longitudinal line male perforating blades and the longitudinal line female perforating blade rollers 51A, 51B; 52A, 52B; and 53A, 53B like that in the cross perforaters 61, 62 and 63. The longitudinal line male perforating blades 51A, 52A and 53A and the longitudinal line female perforation receiving rollers 51B, 52B and 53B are constituted substantially in the same manner as each of the cylinders 61A–63A and 61B–63B of the cross perforaters 61, 62 and 63 excepting that the line perforating blade and the line perforating blade receiving rubber are disposed in the longitudinal direction (delivering direction of the ribbons 14A–14F).

Further, the sizes of the longitudinal line male perforating blades 51A, 52A, 53A and the longitudinal line female perforation receiving rollers 51B, 52B, 53B are identical with the size of the lateral line perforation cylinders 61A, 62A, 63A and the leteral line female perforation cylinders 61B, 62B and 63B, respectively, The driving mechanism for each of the timed longitudinal line male perforaters 51, 52 and 53 is interlocked with the driving mechanism 74 for the each of cross perforater 61, 62 and 63, and the clutch 92, 100, 101, the air cylinder 92, 103, 103, the arms 92, 104, 105 and the air brake 95, 106, 107 for each of the cross perforaters 61, 62, 62 are used in common with the timed longitudinal line male perforaters 51, 52 and 53 respectively. Then, whether each of the timed longitudinal line male perforater 51, 52 and 53 is used or not is selected in accordance with the selection for the each of the cross perforaters 61, 62 and 63.

In the right of FIG. 5, an input gear 77 for driving the timed longitudinal line male perforaters 51, 52 and 53 and the cross perforaters 61, 62 and 63 is connected to a long gear 110 disposed along a tubular shaft bearing 75. The long gear 110 is secured to the main body frame 130 as a stationary portion of the lower folder 30, and it is adapted such that engagement between the input gear 77 and the long gear 110 is kept even when the input gear 77 is moved in the direction X shown by the dotted chain in the drawing.

The long gear 110 is connected by way of a gear 111, bevel gears 112, 113 and a double idler gear 114 successively to a cylinder driving gear 115 secured to the upper slow-down cylinder 43 and, after all, a driving source for each of the timed longitudinal line male perforaters 51, 52 and 53 and the cross perforaters 61, 62 and 63 in the line perforater unit 54 is given by the upper slow-down cylinder 43.

The double idler gear 114 constitutes a helical gear type differential device, which can adjust the phase between each of the cross perforaters 61, 62 and 63 and other portion of the lower folder 30 such as the gripper & tucking cylinder 41. A planetary gear or like other existent differential gear mechanism capable of phase adjustment may be provided to this portion.

Figure 6:
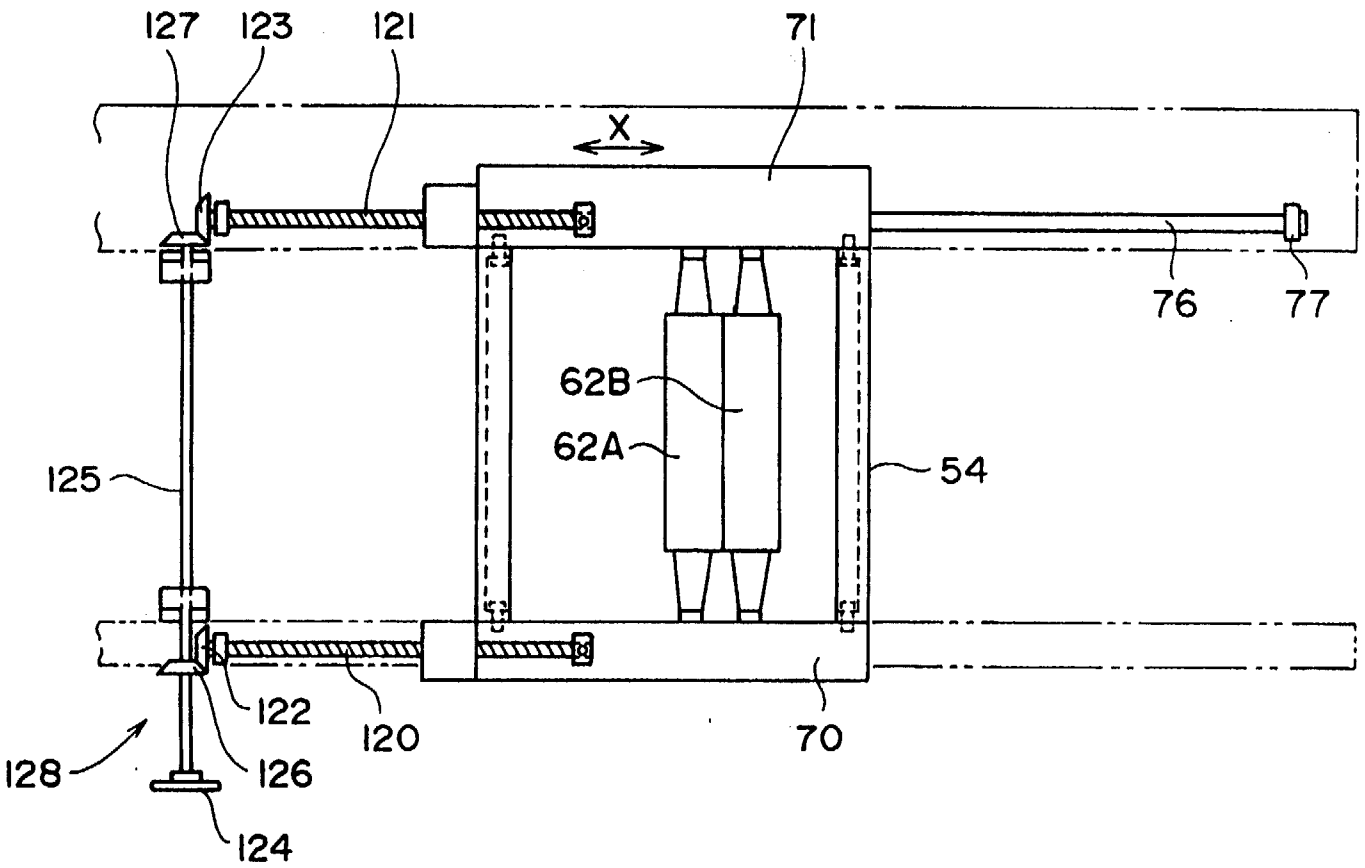
FIG. 6 is a plan view for a moving means of the embodiment.
Figure 7:
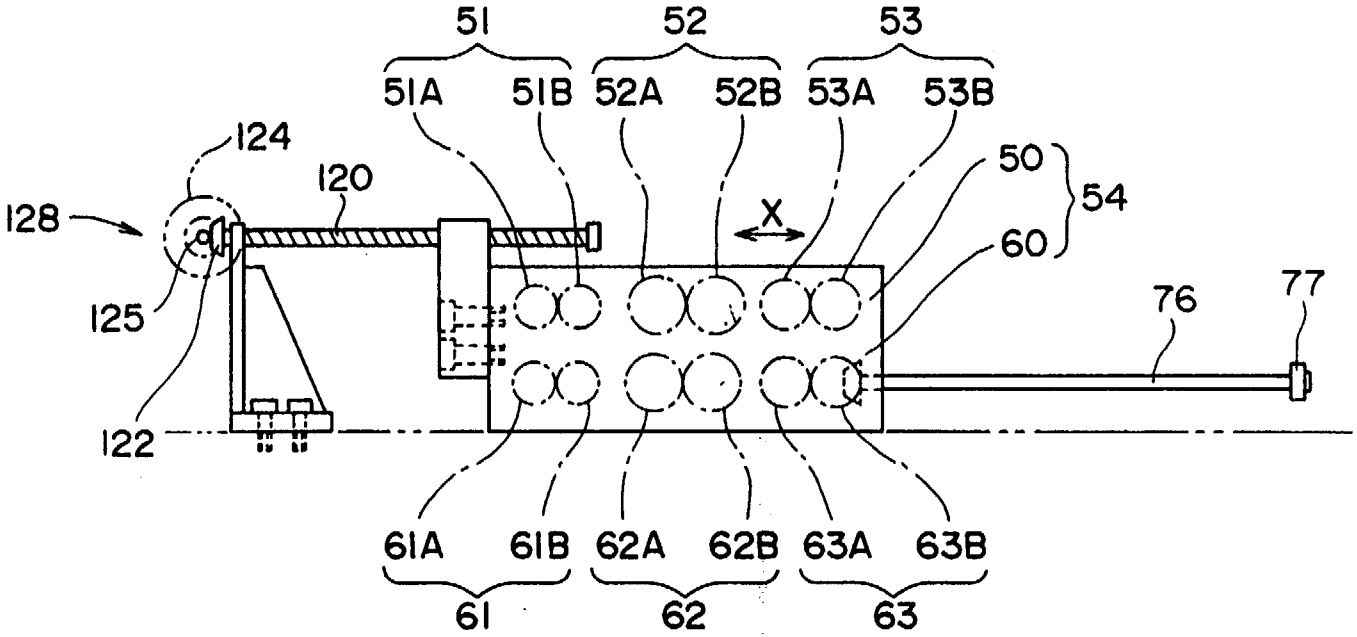
FIG. 7 is an elevational view for a moving means of the embodiment.
Figure 8:
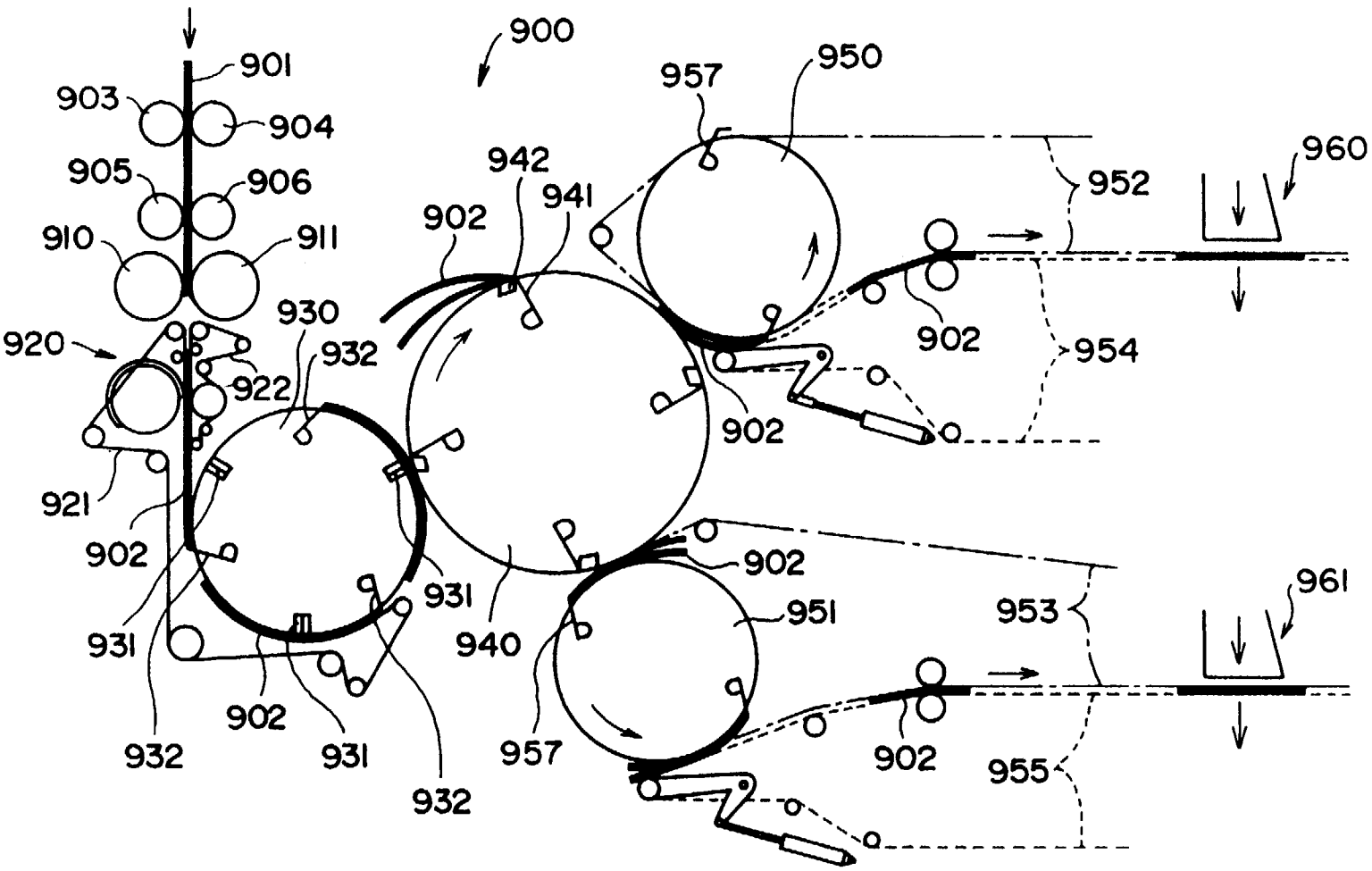
FIG. 8 (PRIOR ART)
FIG. 8 is a view illustrating the constitution of an embodiment in the prior art.
Figure 9:
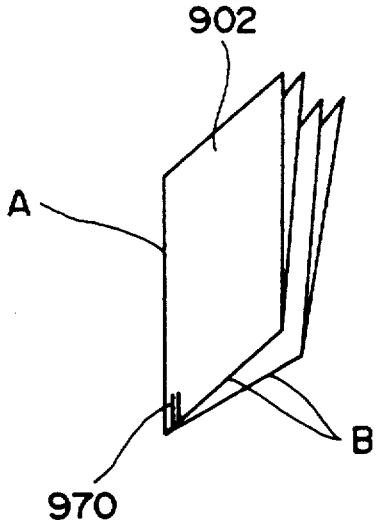
FIG. 9 (PRIOR ART)
FIG. 9 is a view for explaining chopper folding and occurrence of folding wrinkles in the embodiment of the prior art.
Figure 10:
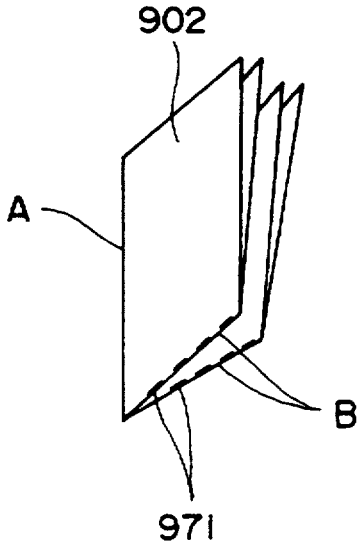
FIG. 10 (PRIOR ART)
FIG. 10 is a view for explaining the cross perforated line, lateral folding and chopper folding.

FIGS. 6 and 7 illustrate a moving mechanism for moving the line perforater unit 54 in the direction X of the drawing (perpendicular to the surface of the print paper), in which FIG. 6 is a plan view and FIG. 7 is an elevational view.

In the drawings, threaded shafts 120 and 121 are disposed, respectively, to the operation side frame 70 and the transmission side frame 71 that surround the line perforater unit 54, and bevel gears 122 and 123 are disposed to the top ends of the threaded shafts 120 and 121, respectively.

Further, a handle shaft 125 having a handle 124 at the top end is disposed in a direction crossing each of the threaded shafts 120 and 121, and bevel gears 126 and 127 meshing with the bevel gears 122 and 123 secured to each of the threaded shafts 120 and 121, respectively, are secured to the handle shaft 125.

The threaded shafts 120 and 121, the handle 124, the handle shaft 120 and each of the bevel gears 122, 123, 126 and 127 constitute a moving means 128 that moves the line perforater unit 54 (the cross perforater unit 60 and the timed longitudinal line male perforater unit 50) in the direction X of the drawing (a direction perpendicular to the surface of the print paper).

The moving means 128 is adapted to rotate the handle shaft 125 by the operation of the handle 124 and move the line perforater unit 54 by transmitting the rotation by way of the bevel gears 122, 123, 126 and 127 to the threaded shafts 120, 121, respectively.

In this embodiment, the moving distance of the line perforater unit 54 in the direction X is defined as 800 mm, but the moving distance may be determined appropriately such that each of the cross perforaters 61, 62 and 63 can be selected in accordance with the number of the cross perforaters 61, 62 and 63 (or timed longitudinal line male perforaters 51, 52 and 52) or the spacing between each of the perforaters.

In this embodiment folded sections are prepared by applying lateral perforated lines to the print paper as described below.

At first, a print paper printed by a printing machine not illustrated disposed to the upstream of the variable size folding machine 10 is introduced from the upper folder 20, applied with cutting, phase adjustment or the like in the upper folder 20 and then delivered as ribbons 14A–14F to the lower folder 30 (refer to FIG. 1).

In the loer folder 30, each of the cross perforaters 61, 62 and 63 and each of the timed longitudinal line male perforaters 51, 52, 53 are previously selected corresponding to the plate cylinder size of the printing machine at the upstream by moving the line perforater unit 54 (cross perforater unit 60 and the timed longitudinal line male perforater unit 50) by the moving means 128 (refer to FIG. 6 and 7).

Then, a longitudinal perforated line is applied by a timed longitudinal line male perforater selected from each of the perforaters 51, 52 and 53, and a lateral perforated line 66 is applied by a cross perforater selected from each of the perforaters 61, 62 and 63 while holding each of the ribbons 14A–14F at the upper and the lower portions by the nipping rollers 24, 25 and 31 and 32 (refer to FIG. 3).

Subsequently, each of the continuous ribbons 14A–14F is cut into the size of the signature 15 by the male cutting cylinder 37 and the female cutting cylinder 38, accelerated by the signature acceleration conveyer 40 and sent to the gripper & tucking cylinder 41. Upon handing from the gripper & tucking cylinder 41 to the jaw cylinder 42, the signatures 15 are folded laterally, alternately distributed into upper and lower portions by the upper deceleration finger 43 and the lower slow-down cylinder 44 and then delivered to upper and lower two choppers 45. The signatures 15 are put to chopper folding (longitudinal folding) in the choppers 45 and then sent to the downward conveyor 46 for discharging.

This embodiment can provide the following advantageous effects.

Since a plurality of the cross perforaters 61, 62 and 63 are disposed to the variable size folding machine 10 and they are used selectively in accordance with the plate cylinder size of the printing machine at the upstream, in other words, in accordance with the signature size, the lateral perforated line 66 can be fabricated also in the variable size folding machine 10.

Therefore, the signature 15 can be folded laterally at the position of the lateral perforated line 66 accurately and stably to improve the accuracy in lateral folding, as well as occurrence of folding wrinkles 970 referred to as "gutter wrinkles" that tend to occur in the variable size folding machine 900 in the prior art can be prevented upon chopper folding.

Further, since each of the cross perforaters 61, 62 and 63 are integrated as the cross perforater unit 60 and the cross perforater unit 60 is made movable by the moving means 128, operation for selecting a necessary cross perforater among each of the line perforaters 61, 62 and 63 can be facilitated.

Further, since the moving means 128 can be constituted easily, for example, by using the threaded screws 120 and 121, it does not complicate the mechanism of the variable size folding machine 10.

Further, since a clutch mechanism comprising the clutch 92, 100, 101, the air cylinder 93, 102, 103 and the arm 94, 104, 105 is disposed individually to each of the cross perforaters 61, 62 and 63, a cross perforater not used among each of the cross perforaters 61, 62 and 63 can be separated from the main body driving side by the clutch mechanism and kept stopped. The situation is the same for the timed longitudinal line male perforaters 51, 52 and 53.

Therefore, since only the cross perforater and the timed longitudinal line male perforater to be used can be rotated by connection with the clutch, energy can be utilized effectively.

Furthermore, since the number of rotation of the shaft 87 used as the shaft for the clutch 92 is equal with that of the lateral line perforation cylinder 61A and the leteral line female perforation cylinder 61B and since the clutch 92 is constituted as a so-called one tooth clutch in which a portion on the side of the idler gear 86 and a portion on the side of the gear 88 can be connected only at a predetermined angle per one rotation for each of the cylinders 61A and 61B, phase shift between the cross perforater 61 and other portion of the lower folder such as the gripper & tucking cylinder 41 upon connection and disconnection of the clutch 92 can be prevented. The situation is the same also for other cross perforaters 62 and 63, and the timed longitudinal line male perforaters 51, 52 and 53.

Further, since each of the cross perforaters 61, 62 or 63 has each of the air brakes 95, 106 or 107, undesirable rotation of the lateral line perforation cylinder 61A, 62A or 63A or the leteral line female perforation cylinder 61B, 62B or 63B not used can reliably be prevented upon disconnecting each of the clutch 92, 100 or 101. The situation is the same for the timed longitudinal line male perforater 51, 52 or 53.

Further, since the driving source for the cross perforaters 61, 62 and 63 is provided by the slow-down cylinder 43, when the chuck folding position of the signature 15 is changed (for instance, in wrap adjustment), the cross perforater 61, 62 or 63 follows after the gripper & tucking cylinder 41 or the jaw cylinder 42 to automatically change the position for fabricating the lateral perforated line 66 by so much as the change for the chuck folding position, phase adjustment for the cross perforater 61, 62 or 63 accompanying the positional change is no more necessary. Further, a similar effect can also be obtained when the gripper & tucking cylinder 41 or the jaw cylinder 42 is used as the driving source.

Further, since the input gear 77 is connected with the long gear 110, driving force can be transmitted reliably from the driving source to the cross perforaters 61, 62 and 3 even if the input gear 77 is displaced.

Furthermore, since the double idler gear 114 constitutes a helical gear type differential device, phase between each of the cross perforaters 61, 62 and 63 and other portion of the lower folder 30 such as the gripper & tucking cylinder 41 can be adjusted by the differential device.

The present invention is not restricted only to the foregoing embodiments but includes other embodiments so long as they can attain the object of the invention and, for example, modifications or changes, for example, as shown below are also included.

That is, in the foregoing embodiment, the three cross perforaters 61, 62 and 63 are provided. However, they are not necessarily restricted to the three devices but any plural number of devices may be used, so long as they are provided by a plurality of numbers such that they can be properly selected and used in accordance with the plate cylinder size of the printing machine, in other words, in accordance with the signature size.

Further, the size applied to each of the cross perforaters 61, 62 and 63 is optional and not restricted only to the concrete numerical values shown in the previous embodiment.

Then, each of the cross perforaters 61, 62 and 63 can be arranged in a optional manner. For instance, they may be arranged not only laterally on a horizontal plane as in the foregoing embodiment but may be arranged longitudinally on the horizontal plane or alternatively, they may be arranged in a so-called revolver type circular arrangement, so long as each of the cross perforaters 61, 62 and 63 are arranged such that they may be moved and arranged properly on a delivery line of the print paper.

Further, although the timed longitudinal line male perforater unit 50 is disposed to the upstream of the cross perforater unit 60 in the foregoing embodiment, the cross perforater unit 50 may be saved in the present invention.

Further, the moving means 128 comprises, for example, threaded shafts 120 and 121 in the previous embodiment. However, the moving means is not restricted only to such a constitution but a moving means using other known mechanisms such as rack-pinion or the like may be employed, so long as the cross perforater unit 60 can be moved as necessary.

Further, although the moving means 128 is manually turned by the handle 124 in the previous embodiment, a constitution for moving the cross perforater unit 60 not manually but by using an electromotive motor or the like may also be employed.

Further, the maximum moving distance by the moving means 128 may be determined optionally with no restriction to the example of concrete numeric values shown in the previous embodiment.

Further, the clutch 92 in the previous embodiment is constituted as a so-called "one tooth clutch" in which the portion on the side of the idler gear 86 and the portion on the side of the gear 88 thereof are connected to each other only at a predetermined angle but any mode of connection may be adopted so long as portions on both sides are connected only at a predetermined angle relative to each other. For instance, a combination of protrusion and recess making an angle of 150° relative to the center of rotation may be disposed on both sides and they are engaged to each other. Thus, connection only at the predetermined angle can be attained with ease by providing an engagement insymmetrical with the plane of rotation.

Further, the clutch 92 is not necessarily the so-called "one tooth clutch" so long as the phase adjustment is conducted by a phase adjusting mechanism, for example, disposed to a separate portion on every selective use for each of the cross perforaters 61, 62 and 63, that is, on every connection of the clutch (for example, a differential device using a double idler gear 114). However, use of the one tooth clutch is preferred since it can simply adjust the phase.

Then, although the clutch 92 is adapted to connect only at a predetermined angle in the previous embodiment, the clutch may be made connectable not at the predetermined angle but at a plurality number of predetermined angles or two predetermined angles in a case where a plurality of lateral line perforating blades 64 are disposed each at an equi-distance to the outer circumference of the lateral line perforation cylinders 61A, 62A and 63A for each of the cross perforaters 61, 62 and 63.

Further, in the previous embodiment, the clutch mechanism comprising, individually, the clutch 92, 100 or 101, the air cylinder 92, 100 or 101, the air cylinder 93, 102 or 103 and the arm 94, 104 or 105 is disposed to each of the cross perforaters 61, 62 and 63, and a not used cross perforater among each of the cross perforaters 61, 62 and 63 is disconnected by the clutch mechanism in the previous embodiment. However, the clutch mechanism may be saved and the cross perforater not used may be left rotated. However, for saving of loss of energy, it is preferred, to dispose the clutch mechanism individually to each of the cross perforaters.

Further, in the present invention, the constitution of the lower folder 30 excepting for the cross perforater unit 60 and the upper folder 20 is not restricted only to the constitution of the previous embodiment.

For instance, the upper folder 20 is constituted for ribbon fold introduction using the turn bars 21A–21F in the previous embodiment. However, it may be introduced without slitting into the ribbons 14A–14F but in the state of former folds as they are, or they may be introduced after slitting into the ribbons 14A–14F and further applying the former folding.

Furthermore, although lower folder 30 is constituted as a folding machine having the choppers 45 distributed into upper and lower two stages but it may be one stage folding machine or may be a folding machine with no chopper 45.

As has been described above according to the present invention, since a plurality of cross perforaters are disposed to the variable size folding machine and one of the plurality of cross perforaters is properly selected and used in accordance with the signature size of the print paper, a lateral perforated line can be applied to the print paper, so that the accuracy in lateral folding of the signature can be improved, as well as occurrence of folding wrinkles upon chopper folding can be prevented.

What is claimed is:

1. A folding machine for folding signatures of variable sizes from printed paper comprising:

a plurality of cross perforaters for respectively applying a lateral perforated line to said print paper, each of said cross perforaters respectively corresponding to a different size of signature obtained by cutting a sheet of said print paper, said plurality of cross perforaters being arranged to allow any one of said cross perforaters to be selected and positioned for applying said lateral perforated line to said print paper;

a group of cylinders, said group at least including cylinders for laterally folding said print paper and which are disposed downstream of said cross perforaters; and a main body driving portion which is adapted to drive said group of cylinders and is constructed and arranged to permit connection to each of said cross perforaters.

2. A folding machine as defined in claim 1, wherein each of said cross perforaters respectively comprises first and second cylinders.

3. A folding machine as defined in claim 2, wherein each of said first cylinders has a respective lateral line perforating blade formed on an outer circumference thereof, and each of said second cylinders has a respective perforating blade receiving means formed on an outer circumference thereof for receiving said lateral line perforating blade of said corresponding first cylinder.

4. A folding machine as defined in claim 1 or 8, wherein said plurality of cross perforaters includes at least three cross perforaters which respectively correspond to signature sizes of $19\frac{3}{8}$ inch, $22\frac{3}{4}$ inch, and 21 inch.

5. A folding machine as defined in claim 1 or 8 further comprising:

a cross perforater unit in which said plurality of cross perforaters are arranged and fixed; and a moving means for moving said cross perforater unit to allow a selected cross perforater to be situated at a predetermined position for applying said lateral perforated line to said print paper.

6. A folding machine as defined in claim 1 or 8, wherein said moving means is adapted to move said cross perforater unit in a direction perpendicular to a surface of said printed paper.

7. A folding machine as defined in claim 1 or 8 further comprising a plurality of clutch mechanisms for individually connecting and disconnecting a rotational transmission between said main body driving portion and a corresponding cross perforater, wherein a portion on the side of said corresponding cross perforater and a portion on the side of said main body driving portion of each of said clutch mechanisms can be connected only at a predetermined angle relative to each other.

8. A folding machine as defined in claim 7, wherein each of said clutch mechanisms is connected and disconnected by operation of a respective air cylinder.

9. A folding machine as defined in claim 7, wherein each of said cross perforaters is provided with a respective air brake for preventing rotation of said cross perforaters disconnected from said main body driving portion by actuating said corresponding clutch mechanism in a disconnected state.

* * * * *